US009850634B1

(12) United States Patent
Campbell et al.

(10) Patent No.: US 9,850,634 B1
(45) Date of Patent: Dec. 26, 2017

(54) AQUATIC PROTECTIVE UNIT

(71) Applicants: Matthew Dwain Campbell, Austin, TX (US); Tyler Ray Ortego, Metairie, LA (US)

(72) Inventors: Matthew Dwain Campbell, Austin, TX (US); Tyler Ray Ortego, Metairie, LA (US)

(73) Assignee: Coastal Resilience Group, L.L.C, Metairie, LA (US)

( * ) Notice: Subject to any disclaimer, the term of this patent is extended or adjusted under 35 U.S.C. 154(b) by 0 days.

(21) Appl. No.: 15/231,371

(22) Filed: Aug. 8, 2016

(51) Int. Cl.
*E02B 3/14* (2006.01)
*E02B 3/04* (2006.01)

(52) U.S. Cl.
CPC ..... *E02B 3/14* (2013.01); *E02B 3/046* (2013.01)

(58) Field of Classification Search
CPC ..... E02B 3/04; E02B 3/06; E02B 3/14; E02B 3/046; E02B 3/129; A01K 61/00
See application file for complete search history.

(56) References Cited

U.S. PATENT DOCUMENTS 954,283 A 3/1910 Hawkes
2,069,715 A 2/1937 Arpin
2,652,692 A 9/1953 Hayden
3,073,061 A * 1/1963 Pearson ..... E04B 2/22 47/33
3,368,357 A 2/1968 Takamori
3,415,061 A 12/1968 Staempfli
3,653,216 A 4/1972 Stickler, Jr.
3,990,247 A 11/1976 Palmer
3,995,434 A * 12/1976 Kato ..... E02B 3/06 405/33
4,229,123 A * 10/1980 Heinzmann ..... E04C 1/395 405/273
4,407,608 A * 10/1983 Hubbard ..... E02B 3/06 405/25
4,431,337 A 2/1984 Iwasa
4,498,805 A * 2/1985 Weir ..... E02B 3/06 405/31
4,711,598 A 12/1987 Schaaf et al.
4,896,996 A 1/1990 Mouton et al.
4,913,595 A 3/1990 Creter, Jr. et al.
4,978,247 A 12/1990 Lenson
4,997,311 A 3/1991 Van Doren
4,998,844 A * 3/1991 Mouton ..... E02B 3/06 405/15
5,074,707 A 12/1991 Greene
5,080,526 A 1/1992 Waters
(Continued)

FOREIGN PATENT DOCUMENTS

EP 0047718 A1 * 3/1982 ..... E02B 3/14

*Primary Examiner* — Tara Mayo-Pinnock
(74) *Attorney, Agent, or Firm* — John B. Edel; Edel Patents LLC

(57) ABSTRACT

Cooperating protection units having both convex and concave walls are disclosed that have the potential to create lengthy protections structures that may be used in the protection of coastal areas. Certain versions of those protective units are configured to have semi-cylindrical wall faces that may cooperate with one another in a lengthy structure and certain other protective units have semi-spherical wall faces that may cooperate with one another in a lengthy structure. Soil and vegetation may accumulate in central cavities of the units.

2 Claims, 4 Drawing Sheets

(56) References Cited

U.S. PATENT DOCUMENTS

| | | | | |
|---|---|---|---|---|
| 5,123,780 | A | 6/1992 | Martinsen | |
| 5,173,006 | A | 12/1992 | Lowe | |
| 5,246,307 | A | 9/1993 | Rauch | |
| 5,259,695 | A | 11/1993 | Mostkoff | |
| 5,269,254 | A | 12/1993 | Gagliano et al. | |
| 5,393,169 | A | 2/1995 | Creter | |
| 5,536,112 | A * | 7/1996 | Oertel, II | E02B 3/06 405/21 |
| 5,620,280 | A | 4/1997 | Melby et al. | |
| 5,803,660 | A | 9/1998 | Warren et al. | |
| 6,106,195 | A * | 8/2000 | Komatsu | E02B 3/02 405/15 |
| 6,186,702 | B1 | 2/2001 | Bartkowski | |
| 6,286,251 | B1 * | 9/2001 | Whitson | A01G 1/08 404/41 |
| 6,491,473 | B2 | 12/2002 | Veazey | |
| 6,565,283 | B1 | 5/2003 | Hall | |
| 6,824,327 | B1 | 11/2004 | Walter | |
| 6,896,445 | B1 | 5/2005 | Engler | |
| 7,144,196 | B1 | 12/2006 | Campbell et al. | |
| 7,513,711 | B1 | 4/2009 | Walter | |
| 7,704,013 | B2 | 4/2010 | Kim | |
| 7,827,937 | B1 | 11/2010 | Walter | |
| 9,144,228 | B1 | 9/2015 | Ortego et al. | |
| 2010/0104366 | A1 | 4/2010 | Melby | |

* cited by examiner

AQUATIC PROTECTIVE UNIT

Aquatic protective units described herein may be used in the protection of wetlands, coastal areas and various other aquatic environments. Certain devices disclosed herein may have particular utility in the restoration of coastal marsh and habitat.

DETAILED DESCRIPTION

Example 1

Figure 1:
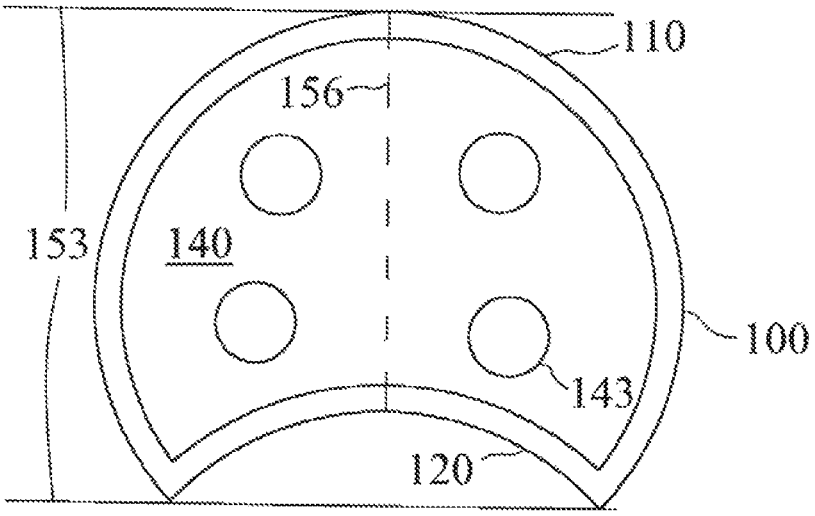
FIG. 1 depicts a plan view of a protective unit.
Figure 2:
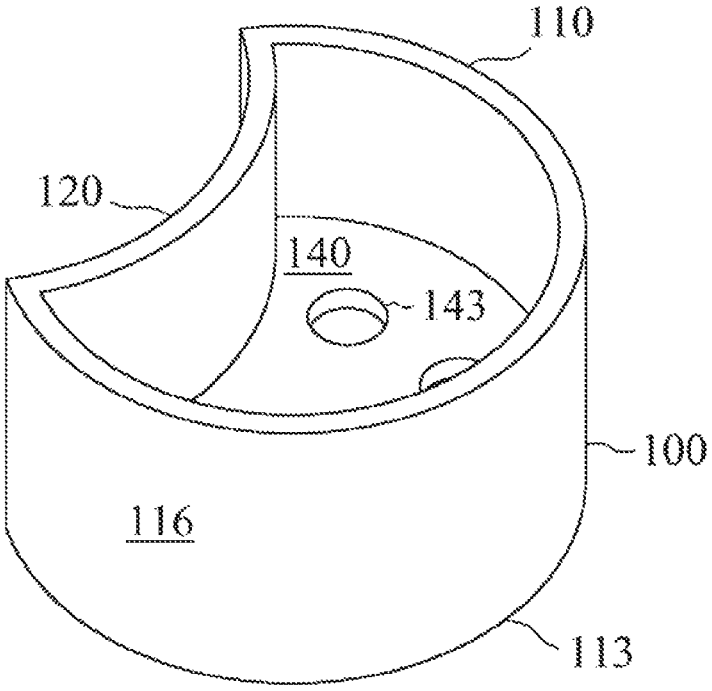
FIG. 2 depicts a perspective view of a protective unit.
Figure 3:
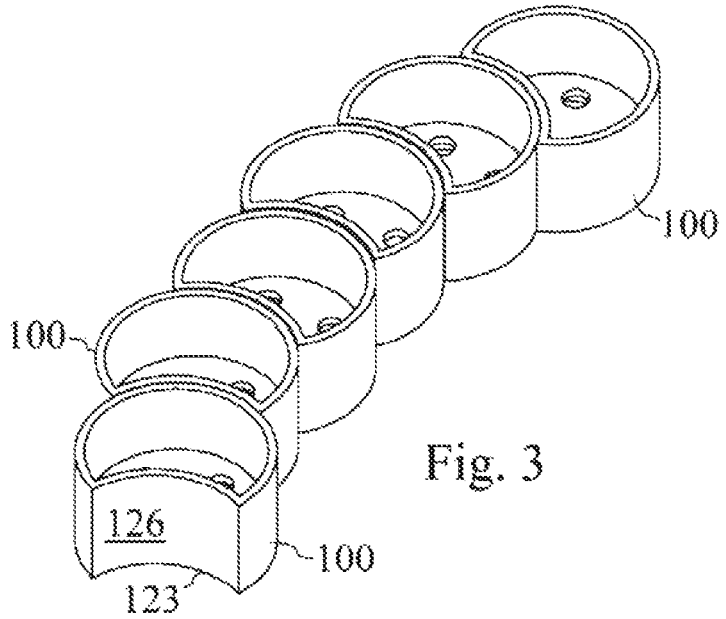
FIG. 3 depicts a perspective view of a series of contiguous coordinating protective units.

In the drawings, FIG. 1 is a plan view of a Protective unit 100, FIG. 2 is a perspective view of that unit and FIG. 3 is perspective view of a series of contiguous coordinating units. Those figures depict Primary wall 110, Primary wall lower rim 113, Primary wall outer face 116, Secondary wall 120, Secondary wall lower rim 123, Secondary wall outer face 126, Unit floor 140 and Filling orifice 143. Also depicted is Minimum width 153 which is the smallest horizontal dimension of Protective unit 100 in its normal orientation. Protective unit 100 along with other protective units may be assembled into a system of protective units configured in a line as depicted in FIG. 3 of the drawings and allowed to accumulate soil and potentially plant matter in the central cavity of the units. Such assemblies may for example occur in the water along a coastline at a depth that allows the top rim of the units to be near the water line for the protection of the coastal area.

Minimum width may, for example, be 7.5 feet with certain examples falling between 5.0 and 9.0 feet and a significant number of those examples falling between 6.3 and 8.3 feet. These minimum width characteristics may apply in any of the examples described herein.

Example 2

Figure 4:
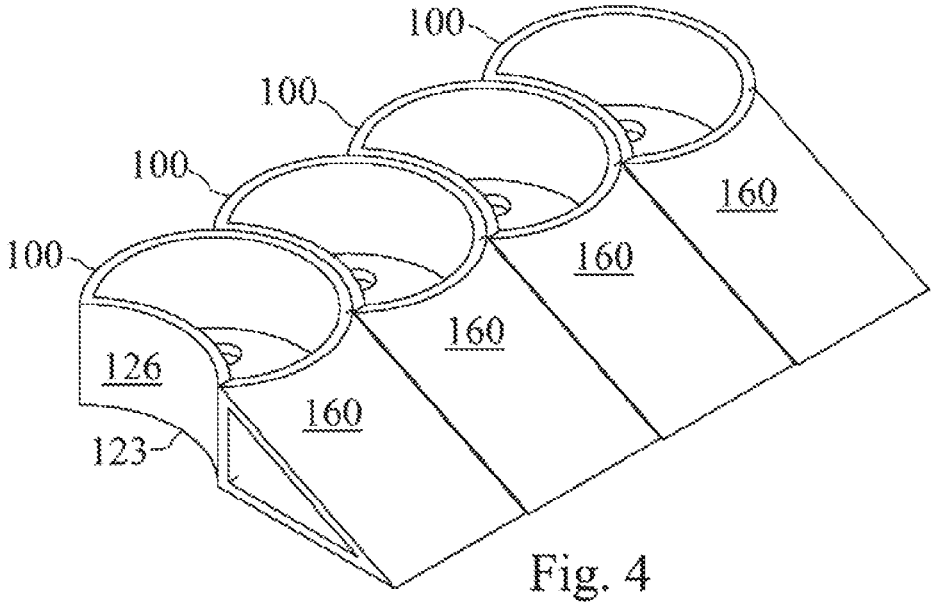
FIG. 4 depicts a perspective view of a series of contiguous coordinating protective units.

FIG. 4 is a perspective view of an embodiment of Protective unit 100. In that embodiment, Wave reflective wedges 160 are included as a part of Protective unit 100. FIG. 4 also depicts Secondary wall lower rim 123 and Secondary wall outer face 126 substantially as described in Example 1. The additional wedge structures may add to the stability of the units and further reduce reflected wave energy. These structures could also provide habitat for organisms.

Example 3

Figure 5:
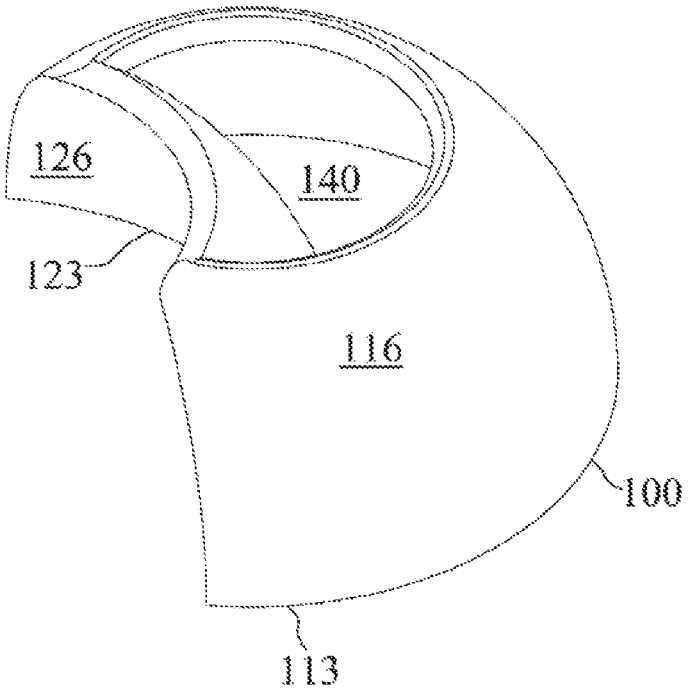
FIG. 5 depicts a perspective view of a protective unit.
Figure 6:
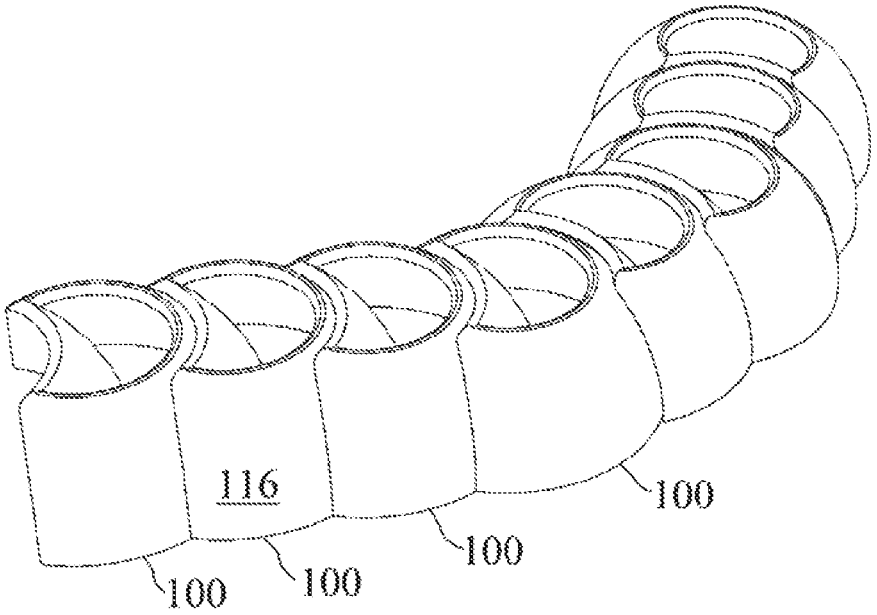
FIG. 6 depicts a perspective view of a series of contiguous coordinating protective units.

In the drawings, FIG. 5 is a perspective view of another version of Protective unit 100 and FIG. 6 is a perspective view of a series of contiguous coordinating units. This version of the units may have features such as Primary wall lower rim 113, Primary wall outer face 116, Secondary wall lower rim 123, Secondary wall outer face 126 along with other features like the previously described units. Units with semi-spherical external faces may be of particular utility in applications where the floor of the body of water in which the units are placed is uneven because the nearly unlimited number of orientations in which units may interface.

Example 4

Figure 7:
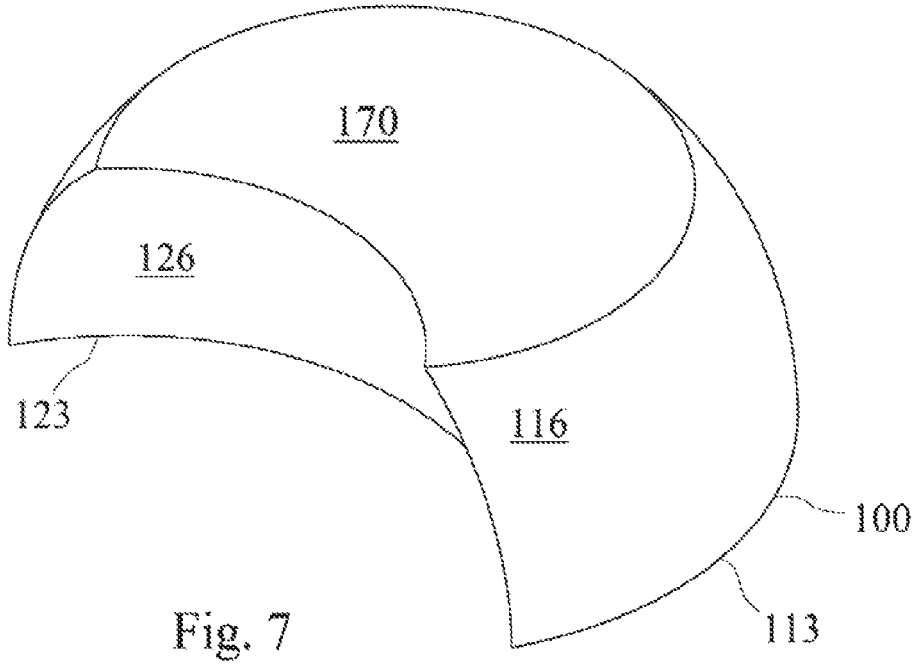
FIG. 7 depicts a perspective view of a protective unit.

In the drawings, FIG. 7 is a perspective view of another version of Protective unit 100 which may be arranged into a series of contiguous coordinating units. This version of the units may have features such as Primary wall lower rim 113, Primary wall outer face 116, Secondary wall lower rim 123, Secondary wall outer face 126 and Unit top 170, along with other features like the previously described units. Protective units with solid centers or mostly solid centers provide many of the benefits of previously described units but may be heavy when material such as concrete is used.

Example 5

Figure 8:
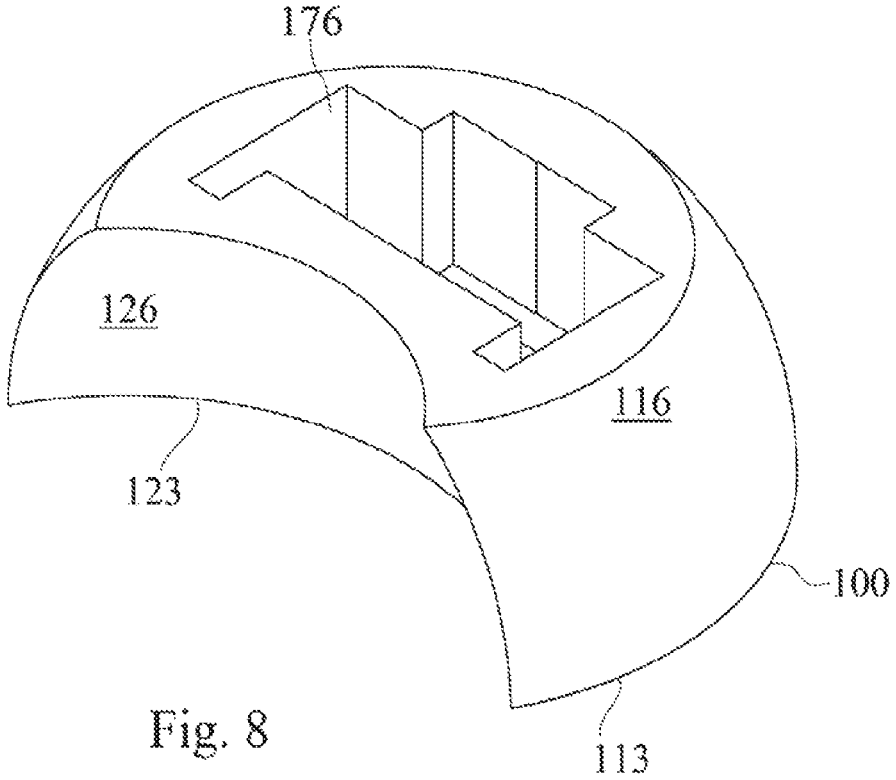
FIG. 8 depicts a perspective view of a protective unit.

In the drawings, FIG. 8 is a perspective view of another version of Protective unit 100 which may be arranged into a series of contiguous coordinating units. This version of the units may have features such as Primary wall lower rim 113, Primary wall outer face 116, Secondary wall lower rim 123, Secondary wall outer face 126 and Center opening 176, along with other features like the previously described units. Protective units with centers that have varying degrees of openness may form a good balance between unit strength and economies relating to the amount of material needed to make the units. Further, openings may provide for a way to place the units by providing a grasping point or some other means by which the units may be mechanically held and put into place by heavy machinery. Open centers may be configured to have a floor, have a floor with openings in the floor, may be configured to have significant opening(s) in the top and the bottom or may be configured in a variety of other ways. Such configurations may be designed to make efficient use of materials, reduce weight, make placement easier, or optimize for various habitat and soil conditions.

Embodiments disclosed may serve as a shoreline protection particularly when multiple units are used cooperatively such as is depicted in FIGS. 3, 4 and 6. The units may be constructed as precast concrete units configured such that they interlock together to form a barrier for waves impacting the shoreline. Individual units may be crescent shaped, when viewed from above, so that they interlock when placed side-by-side. This shape may allow for units to be connected to one another at a nearly unlimited number of angles with certain embodiments allowing a range of contiguous coordinating connections spanning 180 degrees or more. The contiguous coordinating relationship presents a narrow somewhat tortuous path for fluids and entrained solids that may be motivated by differential pressure to cross between the contiguous coordinated walls of the units. The contiguous coordinated walls of the units, when in the water near a shoreline, may not only cause and accumulation of soil within the units, it may cause and accumulation of soil between the wall and the shoreline and in many cases cause and accumulation of soil along the wall opposite the shoreline. The large open cavity within the units provides a protected space for the accumulation of soil and vegetation and may be filled naturally by wave action, may be filled and planted at the initial placement of the units or some combination thereof such as natural filling with later planting. This interlocking nature of the units may allow the structure to act as a marsh containment system and the inside of the unit being a void may serve as a container thereby reducing soil pressure. Units of smaller height can be placed seaward to modify wave breaking, reduce scour, and provide other habitat types.

The geometric parameters may be modified to the environment in which the units are deployed. The individual units may be wide enough to resist forces by waves relative to the height of the structure. The height of the structure may be increased or decreased to regulate overtopping, select for vegetation types, or other design considerations. The sides of the structure may have holes in them to allow for water passage, provide habitat for fish, and reduce wave reflection.

The structure may be filled with soil and planted with vegetation. The structure may be constructed from pervious concrete to allow water to permeate through the sides and provide circulation that will inhibit soil salinity spikes and anaerobic conditions.

The bottom of the units may have holes such as Filling orifice 143 which may allow for easy placement due to the ease with which water may enter the main cavity to overcome buoyant forces of the empty unit. Alternatively, the bottoms of the unit may be open or other orifices may be present that would mitigate the buoyant effects of an air filled empty unit being placed in water. The bottom platform may be offset from the bottom of the cylindrical portion so that when it is placed on the seafloor, the perimeter of the structure is embedded in the soil. When the structure is filled with soil, a tight seal is created between the lower cavity embedded in the soil and the upper cavity. This gives the structure added stability from the unit acting as a suction pile. Alternatively, the units may be constructed with no bottom structure at all such that the walls make up the substantial portion of the units. When the units are backfilled with soil they may achieve a greater stability against movement. Further, the interlocking nature of the units with the close spacing of the units may further resist the displacement of the units by waves or other forces. The bottom of these units may extend beyond the unit floor to be driven into the existing soil. Forward facing pieces such as Wave reflective wedges 160 may reduce wave reflection or provide habitat. Such pieces would generally be oriented seaward of the main body of the unit to reduce wave refection. Those pieces may also have holes to help further reduce that reflection.

Example 6

The exterior walls and lower rims of unit walls may have texture or patterns creating exterior profiles that may not perfectly follow an "arc path." However, as the phrases "arc path" and "follow an arc path" are used herein, texture, patterns and other relatively minor deviations from the "arc path" that are not sufficient to impair a close fitting relationship between a primary wall outer face of one unit and the secondary wall outer face of another unit shall be viewed as following an arc path. For example, an alternate embodiment in which units as described in Example 1 had cooperating corrugated patterns on Primary wall outer face 116 and Secondary wall outer face 126 shall be construed as having a Primary wall lower rim 113 and a Secondary wall lower rim 123 that follow an arc path.

Further Examples

The close fitting relationship depicted in FIGS. 3, 4 and 6 may be further understood by a more detailed description of how two individual units interact as part of a larger system of units. A first unit having a Primary wall 110, Primary wall lower rim 113, Primary wall outer face 116, Secondary wall 120, Secondary wall lower rim 123 and Secondary wall outer face 126 may be placed against a similarly configured second unit having a Primary wall 110, Primary wall lower rim 113, Primary wall outer face 116, Secondary wall 120, Secondary wall lower rim 123 and Secondary wall outer face 126 such that the Secondary wall lower rim 123 and the Secondary wall outer face 126 of the first unit abut the Primary wall lower rim 113 and the Primary wall outer face 116 of the second unit. In such cases the arc of the first unit Primary wall lower rim 113, the arc of the first unit Secondary wall lower rim 123, the arc of the second unit Primary wall lower rim 113 and the arc of the second unit Secondary wall lower rim 123 may all be a particular arc radius. That particular arc radius may, for example, be 5.5 feet with certain examples falling between 1.3 and 7.0 feet and a significant number of those examples falling between 3.4 and 6.3 feet.

The arc center point of the first unit Secondary wall lower rim 123 may be the same location as the arc center point of the second unit Primary wall lower rim 113 or it may be located within one foot of the arc center point of the second unit Primary wall lower rim 113. The arc radius of the Primary wall lower rim 113 of the units is defined herein as a standard radius such that various other dimensions of the units may be described in terms of standard radii. The distance between the Primary wall lower rim 113 radial center of the first unit and the Primary wall lower rim 113 radial center of the second unit when they are abutting each other as in FIGS. 3, 4 and 6 may be referred to as the "unit center separation." The unit center separation may, for example, be 1.3 standard radii with certain examples falling between 0.6 and 1.7 standard radii and a significant number of those examples falling between 1.0 and 1.5 standard radii.

The length of the Primary wall lower rim 113 may, for example, be 4.7 standard radii with certain examples falling between 3.0 and 6.0 standard radii and a significant number of those examples falling between 3.9 and 5.4 standard radii. The length of Secondary wall lower rim 123 may be between 0.8 and 2.3 standard radii, in many cases it may be between 1.1 and 1.9 standard radii and may, for example, be 1.5 standard radii. The height of the units may, for example, be 5.0 feet with certain examples falling between 1.3 and 9.0 feet and a significant number of those examples falling between 3.1 and 7.0 feet. The units may have a Cross sectional width 156 along the line of symmetry. That Cross sectional width 156 may be 1.5 standard radii or may be between 1.2 and 1.8 standard radii. The wall thickness of the units may, for example, be 0.10 standard radii with certain examples falling between 0.02 and 0.20 standard radii and a significant number of those examples falling between 0.04 and 0.10 standard radii.

Materials used in the construction of the units may be resilient enough to withstand wave action anticipated at the location of placement. The units may be constructed of concrete and may have a compressive strength of at least 1000 psi as measured by ASTM 39 Standard Test Method for Compressive Strength of Cylindrical Concrete Specimens.

A method for the placement of any of the units described herein may comprise transporting multiple of those units to a coastal or shoreline area and placing the units in the water such that the tops of the units are near the typical water line and the units interface generally as depicted in FIGS. 3, 4 and 6. The units may be spaced at a constant distance from the shore or follow a path that keeps the tops of the units at a relatively consistent top rim height.

The length of Primary wall lower rim 113 as compared to the length of Secondary wall lower rim 123 allows for multiple units to connect to a Primary wall outer face 116 at the same time such that a series of contiguous coordinating units may be joined in a "Y" configuration without any special joining piece. In such configurations two Secondary wall outer faces 126 would be connected to a single Primary wall outer face 116.

As that term is used herein the term "soil" encompasses a wide variety of materials including dirt, sand, rock, gravel, etc.

Protective structures described herein may, for example, have a first unit comprising: a first wall, a first wall lower rim situated at the base of the first wall, a second wall and a second wall lower rim situated at the base of the second wall and a second unit comprising: a third wall, a third wall lower rim situated at the base of the third wall, a fourth wall and a fourth wall lower rim situated at the base of the fourth wall; such that the third wall may contain concrete; the first wall lower rim follows a first arc path having a first radius; the second wall lower rim follows a second arc path having a second radius; the third wall lower rim follows a third arc path having a third radius; the fourth wall lower rim follows a fourth arc path having a fourth radius; the first radius may be between 1.3 and 7.0 feet; the second radius between 0.7 and 1.3 times the length of the first radius; the third radius may be between 0.7 and 1.3 times the length of the first radius; the fourth radius may be between 0.7 and 1.3 times the length of the first radius; and the first unit and the second unit may be configured such that the entirety of the second wall lower rim may be position adjacent to the third wall lower rim. In related examples, the third wall may have an average thickness of between 1 and 36 inches and in many cases may have an average thickness of between 2 and 24 inches. In a related example, the first radius may be between 3.4 and 6.3 feet. In a related example, the first wall lower rim may have a first wall lower rim arc center; the third wall lower rim may have a third wall lower rim arc center and the first wall lower rim arc center may be separated from the third wall lower rim arc center by a unit center separation distance that may be between 0.6 and 1.7 times the first radius. In a related example, the second wall and the third wall may be arranged to be against one another. In a related example, a third wall lower rim length of the third wall lower rim may be between 0.8 and 2.3 times the first radius. In a related example, the protective structure may have a central cavity between the first wall and the second wall such that the central cavity may be filled with soil. In a related example, the protective structure may have at least two additional units such that the first unit, the second unit and the two additional units may be arranged in water along a shoreline. In a related example, the protective structure may have at least two additional units wherein the first unit, the second unit and the two additional units may be arranged adjacent to one another in a non-linear configuration. In a further related example, the protective structure may have a central cavity between the first wall and the second wall such that the central cavity contains vegetation. In a further related example, the protective structure may have a third unit wherein the first unit, the second unit and the third unit may be arranged as a non-linear series of contiguous coordinating units. In a still further related example, the protective structure may have a third unit wherein the first unit, the second unit and the third unit may be arranged as an equally spaced series of contiguous coordinating units. In a still further related example, the height of the first unit may be between 1.3 and 9.0 feet.

Protective structures described herein may, for example, comprise a first semi-cylindrical wall having a first wall with a first wall external surface that may be convex; a second semi-cylindrical wall having a second wall with a second wall external surface that may be concave; a third semi-cylindrical wall having a third wall with a third wall external surface that may be convex; and a fourth semi-cylindrical wall having a fourth wall with a fourth wall external surface that may be concave; such that the third wall may contain concrete; the first wall external surface may follow a first arc path having a first radius; the first radius may be between 1.3 and 7.0 feet; the second wall external surface may follow a second arc path having a second radius; the second radius may be between 1.3 and 7.0 feet; the third wall external surface may follow a third arc path having a third radius; the third radius may be between 1.3 and 7.0 feet; the fourth wall external surface may follow a fourth arc path having a fourth radius; the fourth radius may be between 1.3 and 7.0 feet; the first wall and the second wall may be components of a continuous first unit perimeter wall; the third wall and the fourth wall may be components of a continuous second unit perimeter wall and the second wall external surface may be configured to be positioned such that a majority of the second wall external surface may be adjacent to the third wall external surface. In related examples, the third wall may have an average thickness of between 1 and 36 inches and in many cases may have an average thickness of between 2 and 24 inches.

Protective structures described herein may, for example, comprise a first semi-spherical wall having a first wall with a first wall external surface that may be convex; a second semi-spherical wall having a second wall with a second wall external surface that may be concave; a third semi-spherical wall having a third wall with a third wall external surface that may be convex and a fourth semi-spherical wall having a fourth wall with a fourth wall external surface that may be concave; such that the third wall may be constructed of concrete; the first wall external surface may follow a first arc path having a first radius; the first radius may be between 1.3 and 7.0 feet; the second wall external surface may follow a second arc path having a second radius; the second radius may be between 1.3 and 7.0 feet; the third wall external surface may follow a third arc path having a third radius; the third radius may be between 1.3 and 7.0 feet; the fourth wall external surface may follow a fourth arc path having a fourth radius; the fourth radius may be between 1.3 and 7.0 feet; the first wall and the second wall may be components of a continuous first unit perimeter wall; the third wall and the fourth wall may be components of a continuous second unit perimeter wall and the second wall external surface may be configured to be positioned such that a majority of the second wall external surface may be adjacent to the third wall external surface. In related examples, the third wall may have an average thickness of between 1 and 36 inches and in many cases may have an average thickness of between 2 and 24 inches.

The above-described embodiments have a number of independently useful individual features that have particular utility when used in combination with one another including combinations of features from embodiments described separately. There are, of course, other alternate embodiments which are obvious from the foregoing descriptions, which are intended to be included within the scope of the present application.

The invention claimed is:

1. A protective structure comprising:

a. a first semi-spherical wall having a first wall external surface that is convex;

b. a second semi-spherical wall having a second wall external surface that is concave;

c. a third semi-spherical wall having a third wall external surface that is convex and d. a fourth semi-spherical wall having a fourth wall external surface that is concave;

e. a central cavity between the first semi-spherical wall and the second semi-spherical wall f. wherein the third semi-spherical wall comprises concrete;

g. wherein the first wall external surface follows a first arc path having a first radius;

h. wherein the first radius is between 1.3 and 7.0 feet;

i. wherein the second wall external surface follows a second arc path having a second radius;

j. wherein the second radius is between 1.3 and 7.0 feet;

k. wherein the third wall external surface follows a third arc path having a third radius;

l. wherein the third radius is between 1.3 and 7.0 feet;

m. wherein the fourth wall external surface follows a fourth arc path having a fourth radius;

n. wherein the fourth radius is between 1.3 and 7.0 feet;

o. wherein the first semi-spherical wall and the second semi-spherical wall are components of a continuous first unit perimeter wall;

p. wherein the third semi-spherical wall and the fourth semi-spherical wall are components of a continuous second unit perimeter wall;

q. wherein the second wall external surface is configured to be positioned such that a majority of the second wall external surface is adjacent to the third wall external surface and r. wherein the first semi-spherical wall and the second semi-spherical wall are immersed within a body of water such that at least a portion of the central cavity is inundated.

2. The protective structure of claim 1 wherein the third wall has an average thickness of between 2 and 24 inches.

* * * * *